United States Patent [19]

Gehly

[11] Patent Number: 4,651,257

[45] Date of Patent: Mar. 17, 1987

[54] MULTIPLE SOURCE LIGHTING FIXTURE

[75] Inventor: Joel C. Gehly, McKean, Pa.

[73] Assignee: American Sterilizer Company, Erie, Pa.

[21] Appl. No.: 754,704

[22] Filed: Jul. 15, 1985

[51] Int. Cl.[4] ..... F21V 13/00

[52] U.S. Cl. ..... 362/33; 362/241; 362/293; 362/298; 362/303; 362/346

[58] Field of Search ..... 362/33, 804, 302, 303, 362/241, 235, 236, 346, 347, 350, 341, 243, 237, 240, 245, 246, 247, 248, 293, 298

[56] References Cited

U.S. PATENT DOCUMENTS

| | | | |
|---|---|---|---|
| 1,655,399 | 1/1928 | Wagner | 362/243 |
| 2,356,592 | 8/1944 | Kolbert et al. | 362/33 |
| 2,586,645 | 2/1952 | Girolami | 362/302 X |
| 2,827,554 | 3/1968 | Gunther et al. | 362/304 |
| 3,923,394 | 12/1975 | Frankviewicz | 362/304 |
| 4,037,096 | 7/1977 | Brendgord et al. | 362/304 |
| 4,404,620 | 9/1983 | Takahashi et al. | 362/304 |

FOREIGN PATENT DOCUMENTS

| | | | |
|---|---|---|---|
| 527566 | 6/1931 | Fed. Rep. of Germany | 362/298 |
| 1065976 | 6/1954 | France | 362/804 |
| 425985 | 10/1947 | Italy | 362/235 |
| 157863 | 12/1936 | United Kingdom | 362/298 |

*Primary Examiner*—Margaret A. Focarino

*Attorney, Agent, or Firm*—Robert D. Yeager; Edward L. Pencoske

[57] ABSTRACT

A lighting fixture having a plurality of light source means arranged circumferentially around the axis of symmetry of the lighting fixture and a reflector system for folding and mixing the light emitted from the light source means to provide a single beam to simulate the light emitted from a single light source means. The light rays converge at an acute angle relative to the axis of symmetry to provide the single beam. The reflector system includes a plurality of source reflectors, each being operatively associated with one light source means, a second reflector positioned beneath the plurality of source reflectors to receive light therefrom in an overlapping fashion, and a third reflector radially spaced and partially circumscribing the source reflectors and the second reflector to receive light from the second reflector and to project that light to form the single beam.

9 Claims, 8 Drawing Figures

MULTIPLE SOURCE LIGHTING FIXTURE

BACKGROUND OF THE INVENTION

1. Field of the Invention

The present invention relates to illumination apparatus, and, more particularly, to a multiple source lighting fixture having a multiple reflector optical system.

2. Description of the Prior Art

Prior approaches to improving surgical lighting have generally relied on increasing the size of the lighting fixture or the number of light sources. For example, Herold U.S. Pat. No. 3,927,313 discloses a surgical lighting fixture having several individual light sources evenly arranged around a central axis. A problem with conventional multiple source lightheads however, is that they produce multiple individual light beams which, in turn, produce multiple shadows when the beams are interrupted.

Single source lightheads eliminate the problem of multiple shadows but do not provide both high intensity and a large pattern of illumination. To achieve the desired intensity, the pattern of illumination must be limited or the wattage of the bulb increased. To achieve a large pattern, the intensity is reduced. Single source surgical lightheads generally offer their best characteristics at a pattern no greater than six inches and an intensity no greater than 6,000 foot candles.

In some applications, such as cardiovascular surgery, a larger area of illumination is desirable. In Europe, the trend is toward larger lights to provide a larger illumination pattern used in conjunction with a smaller light to pinpoint a critical area. Larger lights, however, tend to produce more heat and may overload electrical systems.

Efforts to reduce shadow formation have been made. Brendgord et al. U.S. Pat. No. 4,037,096 which issued on July 19, 1977, discloses a single source lighthead used with a multiple reflector optical system. The light rays are directed by means of the multiple reflectors to approach the illuminated area in an angled relationship to the axis of symmetry of the lighting apparatus, rather than parallel to the the axis. Because the light rays approach objects from all angles, they tend to travel around the object, thus, reducing shadow formation on the desired area.

There is a need for a lighting apparatus which offers the shadow reduction features of the single source lighthead and the large field of illumination of the multiple source lighthead. There is a further need for such an apparatus which will also offer intense illumination without sacrificing the size of the field of illumination and without the production of excessive heat. Finally, there is a need, especially in surgical lighting fixtures, for an apparatus which offers a redundant lighting system so that loss of one source will not reduce or eliminate the pattern of illumination.

SUMMARY OF THE INVENTION

The present invention provides a lighting fixture to illuminate an underlying work surface. The lighting fixture includes a plurality of light source means for emitting light rays, the light source means being arranged circumferentially around the axis of symmetry of the lighting fixture, and a reflector system for folding and mixing the emitted light rays to so project the light rays that they converge at an acute angle relative to the axis of symmetry of the lighting fixture, such converging light rays providing a pattern of illumination on the work surface. Preferably, the converging light rays are so projected that they form a single beam in simulation of light rays projected from a single light source means.

The reflector system includes a plurality of first source reflectors, each of which is operatively associated with one of the light source means and at least partially circumscribes the one light source means with which such source reflector is associated to receive light rays directly from the one light source means and to reflect those light rays so that the reflected light rays have a major directional component generally parallel to the axis of symmetry of the lighting fixture.

The reflector system also includes a second and a third reflector. The second reflector is in axial alignment with the axis of symmetry and is positioned beneath the plurality of source reflectors. The second reflector is configured to so receive the reflected light rays that the reflected light rays from each source reflector partially overlap the adjacent reflected light rays from each adjacent source reflector. The second reflector is adapted to disperse the overlapping reflected light rays outwardly from the axis of symmetry.

The second reflector may have a first contoured surface and a second contoured surface to disperse the overlapping light rays. It may also be at least partially faceted to enhance dispersement of light rays.

The third reflector is radially spaced from the first and second reflectors in axial alignment with the axis of symmetry. The third reflector at least partially circumscribes the plurality of first source reflectors and the second reflector so that the third reflector receives the dispersed light rays from the second reflector and projects them in a manner that permits the dispersed light rays to converge at an acute angle relative to the axis of symmetry to provide the pattern of illumination.

BRIEF DESCRIPTION OF THE DRAWINGS

The present invention can be better understood by reference to the drawings in which.

DETAILED DESCRIPTION OF THE PREFERRED EMBODIMENT

Figure 1:
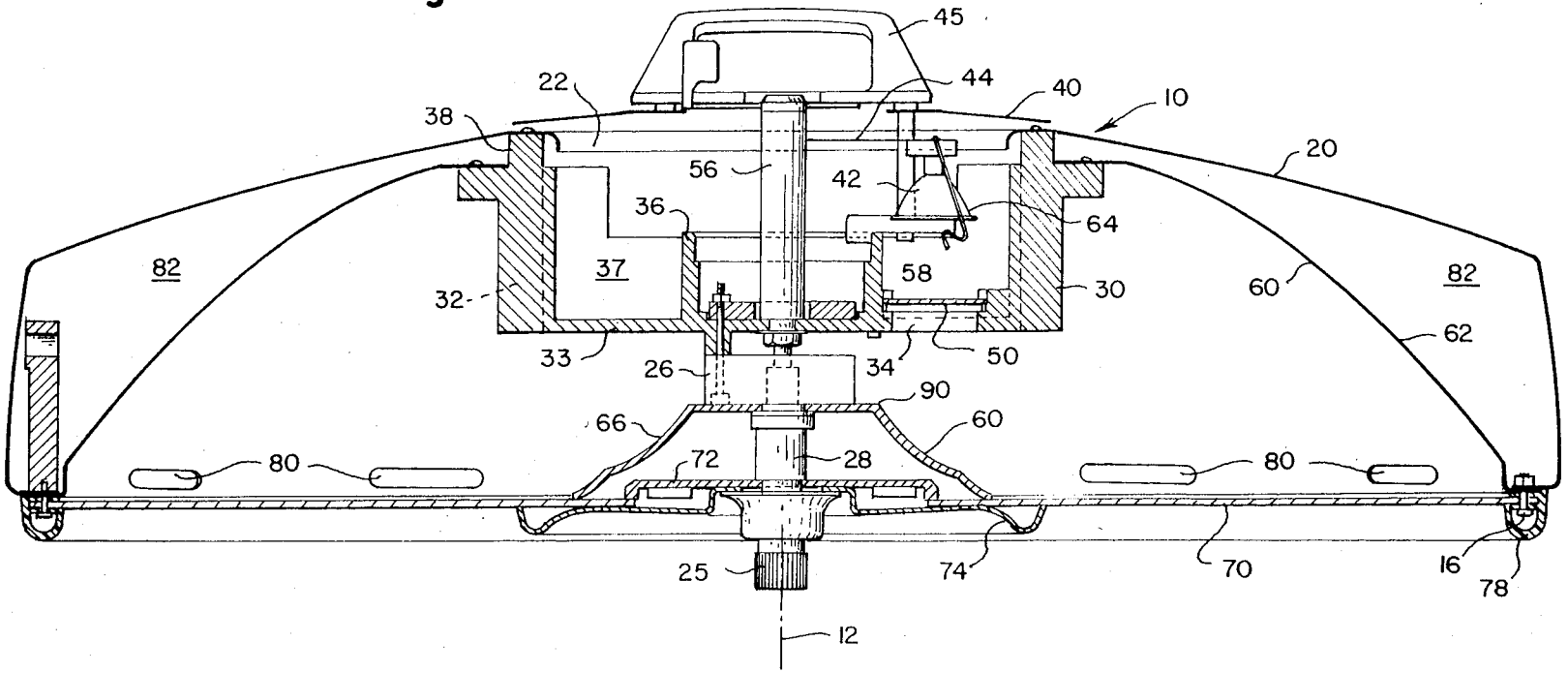
FIG. 1 is a side elevation section view of the preferred embodiment of the lighting fixture 10 of the present invention.
Figure 2:
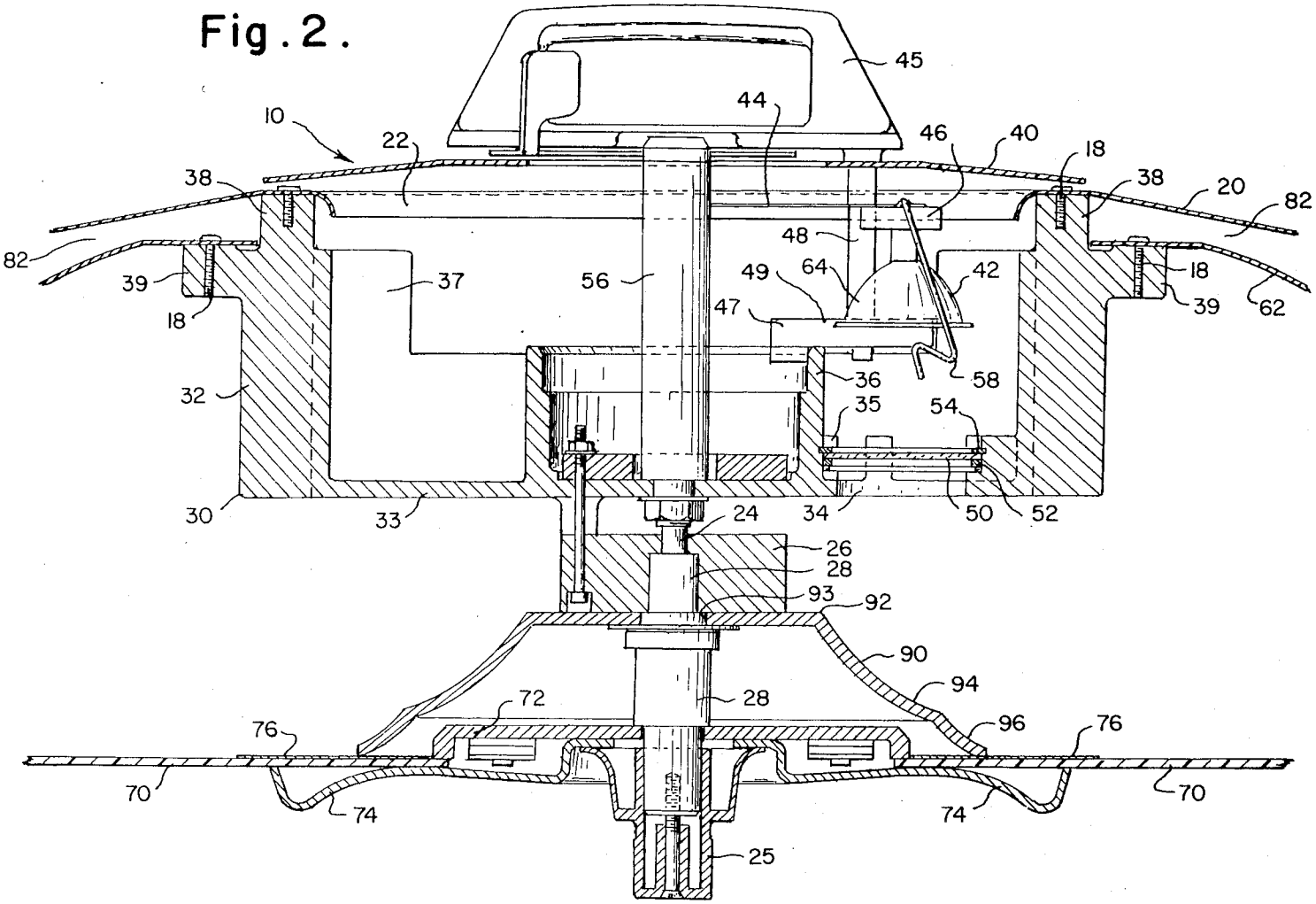
FIG. 2 is a close up of a portion of the section view of FIG. 1.

FIGS. 1 through 8 illustrate the preferred embodiment of the lighting fixture 10 of the present invention. The lighting fixture 10, having an axis of symmetry 12, includes generally an outer shell 20, a lamp holder assembly 40 and a reflector system 60.

The lamp holder assembly 40 is positioned in a housing 30 of lighting fixture 10 over an opening 22 in outer shell 20. The housing 30 is a cylindrical structure having outwardly extending radial ribs 32, a bottom 33 defining openings 34 and an inner annular member 36. Spokes 37 connect the outer cylinder of housing 30 to the inner annular member 36. There are preferably eight to twelve openings 34 arranged circumferentially around annular member 36, one opening 34 positioned between each of two adjacent spokes 37. Portions 38 join housing 30 to outer shell 20 by means of a screw 18. Portions 39 join housing 30 to a concave reflector 62, also by means of screws 18. Extensions 31 and 35 support a filter 50, gaskets 52 and a retaining ring 54 in each opening 34.

The lamp holder assembly 40 includes a plurality, preferably eight to twelve, tungsten halogen lamps, or light sources 42. Each light source 42 is operatively associated with and held within a contiguous source reflector 64 positioned over each filter 50 in the openings 34. The multiple light sources 42 can be arranged in a relatively small area and each should be precisely located relative to its source reflector 64 to produce a precise light pattern. In a preferred embodiment, each reflector 64 has a rim diameter of about two inches.

A plate 44 holds lamp sockets 46 from which the source reflectors 64 and light sources 42 are suspended. A portion of the lower rims of each source reflector 64 rests on spokes 49 which radiate from insulated ring member 47. Clips 58 are pivotally attached at one end to plate 44 and lock at the other end into a recess in the bottom of spokes 49 to hold source reflectors 64 in position.

A support member 48 joins the cover 41 of the lamp holder assembly 40 and plate 44 to spokes 49. The lamp holder assembly 40 also includes handle 45. The spokes 49 rest on the upper rim of the inner annular member 36. Guide 56 is axially aligned with the axis of symmetry 12 of lighting fixture 10.

A bolt 24 extends through the bottom 33 of housing 30 to connect guide 56 to block 26. A shaft 28 joins block 26 to a handle 25. A lens plate 72 and lower cover plate 74 sandwich lens 70 between them to support its central portion. The outer edges of lens 70 are held by trim rings 78. Bolts 16 join the trim rings 78, lens 70, concave reflector 62 and outer shell 20.

The reflector system 60 includes source reflectors 64, a uniquely configured, outwardly directing reflector 66 and a large outwardly spaced concave reflector 62. Each source reflector 64 preferably has "cold mirror" properties. The source reflectors 64 are preferably dichroic coated glass reflectors which aid in the removal of radiant infrared energy through the back of the lighting fixture 10. The filters 50 are preferably hot mirror coated roundel filters adapted for color correction. Additional heat is removed through vents 80 in concave reflector 62. The heat escapes through the space 82 defined between outer shell 20 and concave reflector 62 between portions 38 to opening 22. Any suitable means of removing heat to the top of the lighting fixture 10, away from the surface to be illuminated can be employed.

Outwardly directing reflector 66 is positioned beneath housing 30 and filters 50 so that light rays from the light sources 42 are directed through filters 50 onto the surface 90 of reflector 66.

Figure 5:
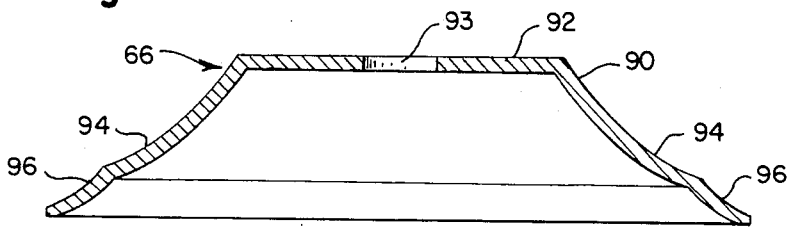
FIG. 5 is a side elevation section view of the second reflector.
Figure 6:
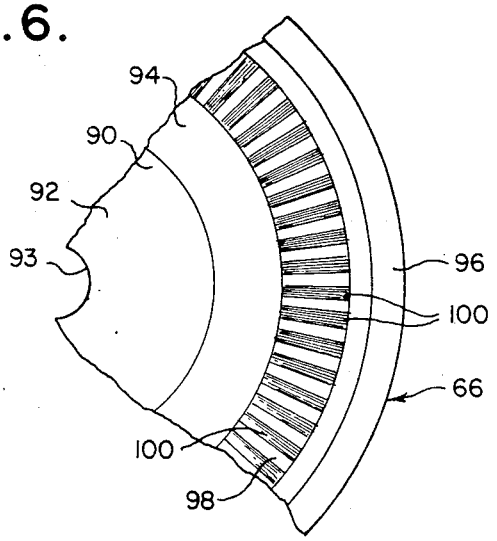
FIG. 6 is a partial top plan view of the second reflector showing an annular faceted portion.
Figure 7:
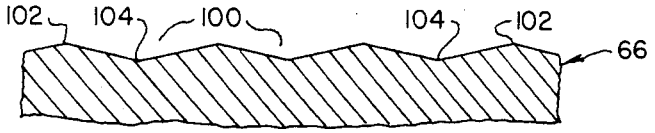
FIG. 7 is a section view along the line VII—VII of FIG. 6 showing the facets along the surface of the second reflector.

As shown in FIGS. 5, 6 and 7, surface 90 of reflector 66 includes an upper flat portion 92 having an opening 93 through which the shaft 28 passes. Surface 90 also includes a first contoured portion 94 and a second contoured portion 96. Contoured surface 94 is generally upwardly concave and includes two differently radiused areas. Contoured surface 96 includes two generally flat, angled areas. Contoured portion 94 may include a faceted annular region 98 having facets 100. Facets 100 form a ring of crests 102 and valleys 104 around reflector 66. The facets 100 aid in directing light rays outwardly from reflector 66 onto reflector 62 at a desired angle.

A glare shield 76 is provided to collect and prevent stray light from exiting through lens 70. Lens 70 is preferably a diffusion lens to add uniformity to the pattern of illumination.

Figure 8:
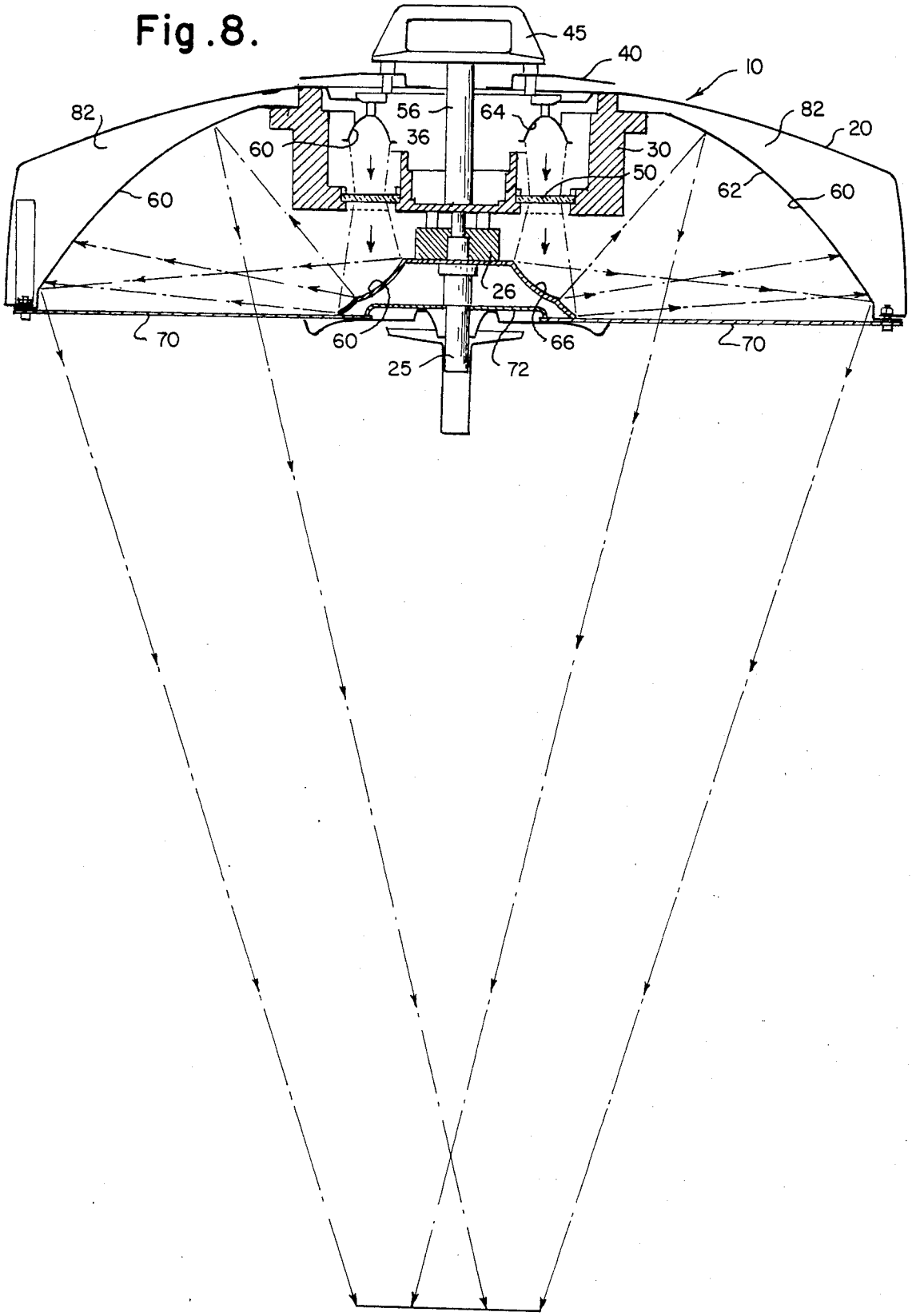
FIG. 8 is a side elevation diagrammatic view of the lighting fixture of the present invention showing the direction of light rays onto a work surface.

Referring to FIG. 8, light is directed from each light source 42 onto its integral source reflector 64. The rays are reflected downwardly through filters 50 so that the reflected light rays have a major directional component generally parallel to the axis of symmetry 12. The rays are thus directed onto the first and second contoured portions 94 and 96, respectively, of surface 90 of reflector 66. The unique configuration of surface 90 disperses the rays outwardly onto reflector 62 at an improved angle which mixes the rays from the multiple light sources. The rays impinging upon reflector 62 are projected through lens 70 and approach the area to be illuminated in an angled relationship relative to the extended axis of symmetry 12 so that all of the rays would eventually intersect the extended axis 12 if uninterrupted by the surface to be illuminated. By angling the approach of the light rays shadow formation is reduced significantly when an object is introduced into the path of the rays. If the rays were to be directed parallel to the axis 12 from multiple light sources, multiple shadow formation would result when the multiple beams are interrupted.

The method of folding the light rays mixes the rays to approximate the beam from a single light source so that only a single shadow is produced when the rays are interrupted. The contoured surfaces 94 and 96 of reflector 66 helps to disperse the rays to enhance folding and mixing.

The reflector system 60 of the present invention coupled with the multiple light sources 42 provides a broader pattern of illumination with excellent single shadow reduction, at a greater intensity than has been heretofore available with other single or multiple source systems. In addition, the multiple light sources 42 offer redundancy so that the loss of one light source 42 does not significantly interfere with the intensity of illumination or degrade the pattern. Even after a partial burnout, the pattern of illumination remains substantially, and preferably completely, unchanged.

Figure 4:
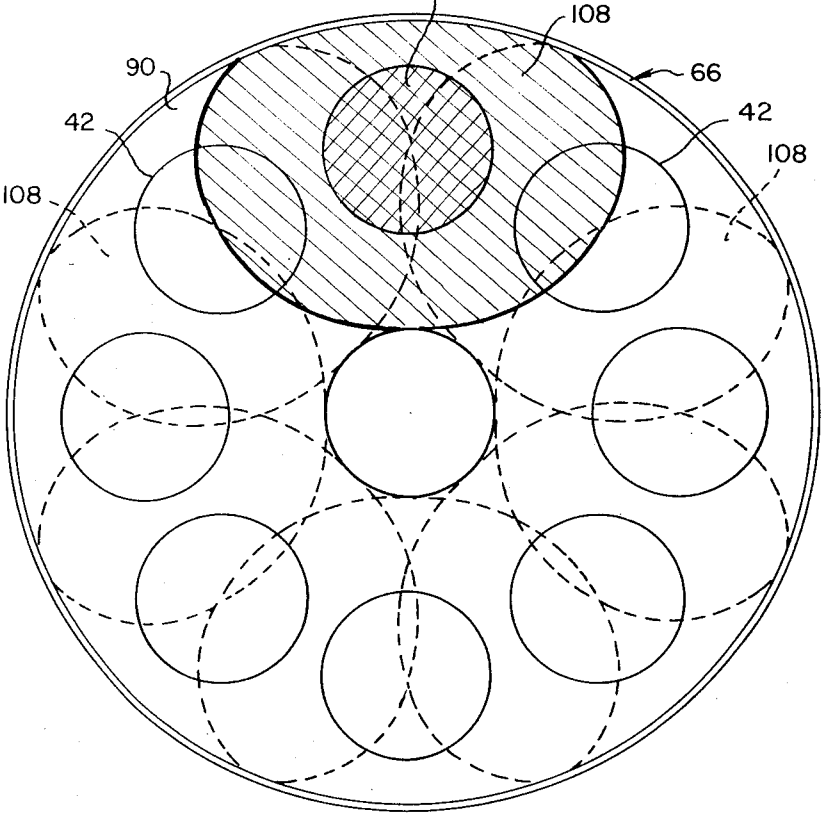
FIG. 4 is a diagrammatic view of the pattern of light impinging upon the second reflector of the lighting fixture of the present invention.
Figure 3:
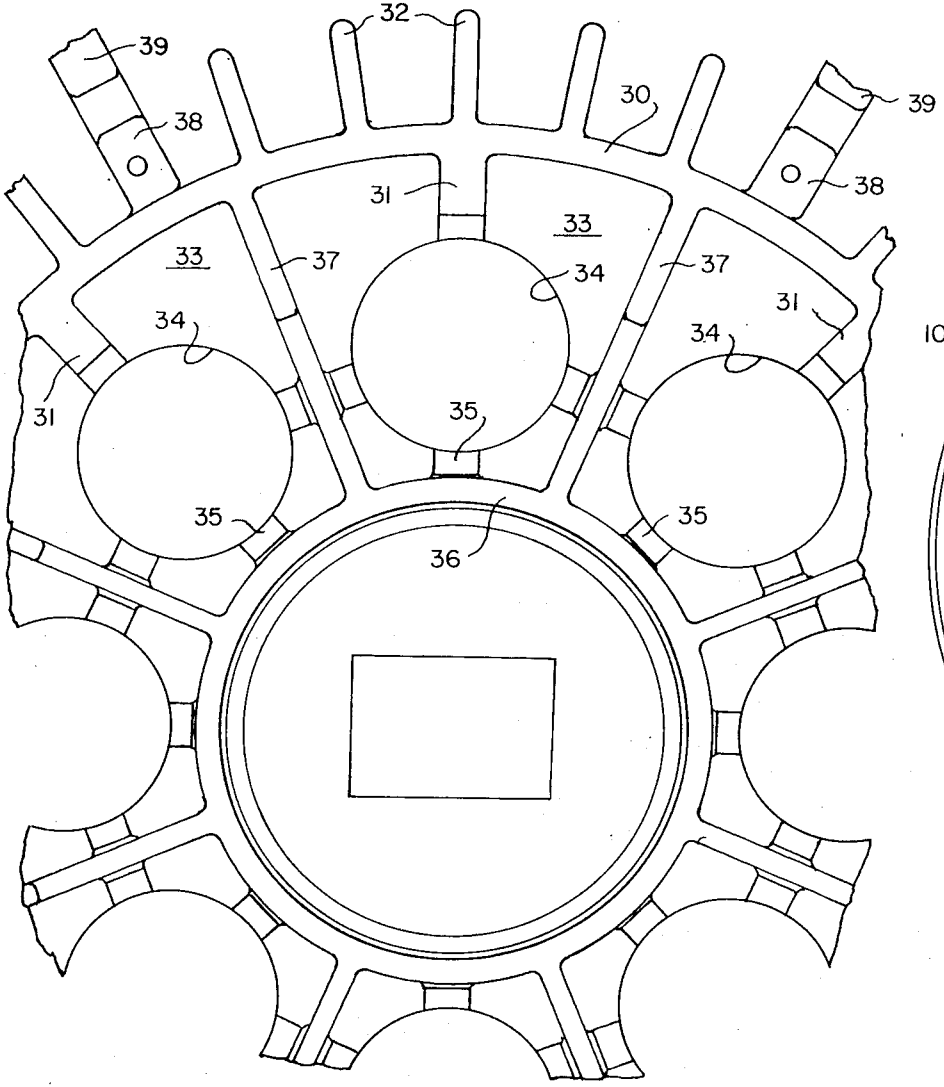
FIG. 3 is a partial top plan view of the housing for the light sources of the lighting fixture of FIG. 1.

Each light source 42 is of a relatively low voltage and relatively small size so that excessive heat is not produced from the multiple sources 42. As shown in FIG. 4, the light rays impinging upon surface 90 of reflector 66 from each light source 42 are arranged and oriented to form a parabolic pattern 108 which overlaps the adjacent parabolic patterns formed by the adjacent light sources 42 so that light is evenly distributed over contoured surfaces 94 and 96. Prior art multiple light sources formed multiple hot spots without mixing the light. The profile of reflector 66 accommodates the multiple light sources to avoid the formation of multiple hot spots.

Thus, the folded optical system provided by the reflector system 60 and multiple light sources 42 arranged circumferentially around the axis of symmetry 12 of the lighting fixture 10 of the present invention provides a broader pattern of illumination without sacrificing lighting intensity or significantly reducing shadow formation. The resulting pattern size and intensity can be varied to desired optimum conditions by optimizing the number, orientation and total wattage of the multiple light sources 42.

What is claimed is:

1. A lighting fixture to illuminate an underlying work surface comprising:

a plurality of point light source means for emitting light rays, said plurality of point light source means being arranged circumferentially around an axis of symmetry of the lighting fixture;

a plurality of first source reflectors, each said source reflector being operatively associated with a one of said point light source means and at least partially circumscribing said associated point light source means to receive light rays directly from said associated point light source means and to reflect such light rays so that the reflected light rays have a major directional component generally parallel to said axis of symmetry;

a second reflector in axial alignment with said axis of symmetry of the lighting fixture, said second reflector being positioned beneath said plurality of source reflectors and configured to receive the reflected light rays from each said source reflector, said received light rays partially uniformly overlapping with received light rays from adjacent source reflectors to mix said light rays, said second reflector being contoured to disperse said overlapping received light rays outwardly from said axis of symmetry to further enhance uniform mixing of said light rays; and a third reflector radially spaced from said first and second reflectors in axial alignment with said axis of symmetry, said third reflector at least partially circumscribing said plurality of first reflectors and said second reflector so that said third reflector receives said dispersed light rays from said second reflector and projects said dispersed light rays so that said dispersed light rays converge at an acute angle relative to said axis of symmetry to provide an illumination pattern of uniform intensity on the work surface.

2. A lighting fixture as recited in claim 1 wherein said second reflector includes a first contoured surface and a second contoured surface with said second contoured surface having a greater diameter than said first contoured surface, said first and second contoured surfaces dispersing said overlapping received light rays outwardly to said third reflector.

3. A lighting fixture as recited in claim 2 wherein said second contoured surface includes an annular faceted portion.

4. A lighting fixture as recited in claim 2 wherein said first contoured surface includes an annular faceted portion.

5. A lighting fixture as recited in claim 2 wherein said first contoured surface is an annular, generally upwardly concave surface having a lower edge from which said second contoured surface radially extends in a generally outward and downward direction.

6. A lighting fixture as recited in claim 1 wherein said second reflector includes a plurality of facets to disperse said overlapping received light rays.

7. A lighting fixture as recited in claim 1 further comprising a plurality of filters, each of said filters being so positioned beneath a one of said plurality of source reflectors that the reflected light rays from the one said source reflector pass through said filter before impinging said second reflector.

8. A lighting fixture as recited in claim 1 further comprising means to remove infrared rays emitted from said plurality of point light source means and to direct such infrared rays away from the work surface.

9. A lighting fixture as recited in claim 1 wherein said plurality of point light source means includes eight point light source means and wherein said plurality of first source reflectors includes eight source reflectors.

* * * * *